US008277368B2

(12) United States Patent
Ackermann et al.

(10) Patent No.: US 8,277,368 B2
(45) Date of Patent: Oct. 2, 2012

(54) FOLDING MACHINE AND KNIFE HOLDER FOR A KNIFE SHAFT OF A FOLDING MACHINE

(75) Inventors: Herbert Ackermann, Baldringen (DE); Jürgen Kübler, Marbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 448 days.

(21) Appl. No.: 12/507,897

(22) Filed: Jul. 23, 2009

(65) Prior Publication Data

US 2010/0022376 A1 Jan. 28, 2010

(30) Foreign Application Priority Data

Jul. 28, 2008 (DE) ..... 10 2008 035 108

(51) Int. Cl.
*B31B 1/56* (2006.01)

(52) U.S. Cl. ..... 493/454; 493/397; 493/424

(58) Field of Classification Search ..... 493/454, 493/397, 399, 404, 355, 424, 434; 270/21.1, 270/20.1, 32, 47
See application file for complete search history.

(56) References Cited

U.S. PATENT DOCUMENTS

| | | | | |
|---|---|---|---|---|
| 945,106 | A | 1/1910 | Moodey | |
| 1,196,912 | A * | 9/1916 | Weck | 493/396 |
| 3,180,007 | A * | 4/1965 | Gartz | 492/38 |
| 3,917,254 | A * | 11/1975 | Watrous | 493/399 |
| 4,524,962 | A | 6/1985 | Davenport et al. | |
| 4,823,659 | A * | 4/1989 | Falasconi | 83/100 |
| 5,419,224 | A | 5/1995 | Gamperling et al. | |
| 6,250,622 | B1 | 6/2001 | Fowler et al. | |
| 7,247,131 | B2 | 7/2007 | Belmann et al. | |
| 7,563,220 | B2 | 7/2009 | Harris et al. | |
| 2008/0295713 | A1 | 12/2008 | Namiki et al. | |

FOREIGN PATENT DOCUMENTS

| | | | |
|---|---|---|---|
| DE | 520 629 | | 3/1931 |
| DE | 41 23 130 | A1 | 3/1992 |
| DE | 42 29 699 | A1 | 3/1994 |
| DE | 100 20 316 | A1 | 12/2000 |
| DE | 10 2008 015 247 | A1 | 12/2008 |
| EP | 1 475 335 | A1 | 11/2004 |
| EP | 1937464 | A1 | 7/2008 |
| JP | 2004238174 | A | 8/2004 |
| WO | 86/01773 | A1 | 3/1986 |
| WO | 2007023258 | A1 | 3/2007 |

OTHER PUBLICATIONS

German Patent and Trademark Office Search Report, dated Feb. 19, 2009.
European Search Report dated Oct. 22, 2009.

* cited by examiner

*Primary Examiner* — Sameh H. Tawfik
(74) *Attorney, Agent, or Firm* — Laurence A. Greenberg; Werner H. Stemer; Ralph E. Locher

(57) ABSTRACT

A folding machine for folding sheets of paper, board and the like, includes at least one knife-shaft unit for cutting, perforating, scoring or crimping the sheets. The knife-shaft unit has at least one pair of driven knife shafts. Knife-retaining units for retaining knives are fitted in a rotationally fixed manner on the knife shafts. The knife-retaining units have a split construction and are formed by a plurality of partial shells. A knife holder for a knife shaft of a folding machine, is also provided.

10 Claims, 13 Drawing Sheets

FOLDING MACHINE AND KNIFE HOLDER FOR A KNIFE SHAFT OF A FOLDING MACHINE

CROSS-REFERENCE TO RELATED APPLICATION

This application claims the priority, under 35 U.S.C. §119, of German Patent Application DE 10 2008 035 108.3, filed Jul. 28, 2008; the prior application is herewith incorporated by reference in its entirety.

BACKGROUND OF THE INVENTION

Field of the Invention

The invention relates to a folding machine for folding sheets of paper, board and the like, having at least one knife-shaft unit for cutting and/or perforating and/or scoring and/or crimping and/or transporting the sheets. The knife-shaft unit has at least one pair of driven knife shafts on which at least one processing unit is mounted in a respectively rotationally fixed manner in each case. The invention also relates to a knife holder for a knife shaft of a folding machine, having two tubular elements which can be screw-connected to one another by threads to form the knife holder.

Folding machines of that type are known from the prior art as combination folding machines. In the case of those combined buckle-folding/knife-folding machines, the parallel folds are folded in accordance with the buckle-folding principle in a first folding station, while the following cross folds are executed in each case using a vertically operating folding knife. In that case, the buckle-folding principle produces folds which are located perpendicularly to the direction in which the sheets are transported as they enter into the buckle-folding device, whereas the knife-folding principle produces folds which run parallel to the direction in which the sheet is transported as it enters into the knife-folding device.

A folding knife pushes the sheet downward between two folding rollers, which grip the sheet and fold it. The various possible configurations which are known also include those in which a plurality of knife-folding devices are provided one after the other, in which case a plurality of cross folds can be executed one after the other. Moreover, further processing units, for example buckle plates with folding rollers and/or knife shafts for cutting, perforating or scoring the sheet, are also sometimes provided between the knife-folding devices.

Knife-folding devices are thus used primarily in order to produce folds in the sheet which run perpendicularly, rather than parallel, to the leading edge of the sheet. The knife-folding principle gives rise in that case to a change in the transporting direction of 90° in the same plane. The knife in a second knife-folding device is thus likewise rotated through 90° in the same plane relative to the first knife-folding device. A third knife-folding device would then be disposed parallel to the first knife-folding device again, albeit on a lower level. That gives rise to a problem where the knife-folding devices provided at right angles in relation to one another make it difficult to access the downstream folding rollers of buckle-folding devices and/or knife shafts.

There are different approaches to overcoming that problem. In the first instance, there is a combination folding machine from the firm MBO in which the entire knife-folding unit, including folding knife, feed device and folding rollers, is swung upward in order to release the space around the paper plane in which the knife shafts are disposed. However, that has the disadvantage that those knife shafts are still difficult to access, particularly in the case of knife shafts which are disposed downstream of the second knife-folding device.

German Published, Non-Prosecuted Patent Application DE 41 23 130 A1 specifies a folding machine in which, inter alia, a plurality of folding devices are configured such that they can be swung out and/or pushed out and/or rotated and/or pivoted out. In addition, those folding devices are configured such that they can easily be moved as an entire unit, including the folding device and possibly additional devices such as knife shafts, perforating devices or the like, out of the folding-device assembly, and that they can be pivoted back into the folding-device assembly without any maintenance or adjustment being required.

A further possible solution to the problem is specified in European Patent Application EP 1 475 335 A1. In that case, a knife-shaft unit is pulled outward as a cassette through the side wall, and straightforward exchange and/or readjustments are therefore possible. However, on one hand, that has the disadvantage that the device, in the pulled-out state, takes up a very large amount of space. On the other hand, the long lever in the pulled-out state means that the stability of the drawer in which the cassette is guided has to meet stringent requirements in order for lateral impact not to result in damage. Moreover, the device is also unsuitable for knife-folding devices since, as has already been described, in that case the knife shafts are disposed one above the other and in a formation in which they are rotated 90° in relation to one another.

According to the prior art, the knife shafts have tubular portions, so-called transporting rollers, pushed onto them for assisting the sheets in running properly as well as so-called knife holders for retaining knives. In order for the knife shafts to be adapted for job changeover, the knife shafts are removed from the folding machine and the knife holders appropriate for the job are installed. In order to exchange the transporting rollers, the knife shafts likewise have to be removed from the folding machine. Those operating processes are time-consuming and adversely affect the changeover time period.

In the case of large folding machines for processing sheets of large width, the above-described swing-action and pushing-action devices are subjected to high forces and moments, which have to be countered by corresponding dimensioning.

SUMMARY OF THE INVENTION

It is accordingly an object of the invention to provide a folding machine and a knife holder for a knife shaft of a folding machine, which overcome or at least reduce the hereinafore-mentioned disadvantages of the heretofore-known devices of this general type and which ensure improved adaptation and adjustability of the knife shaft.

With the foregoing and other objects in view there is provided, in accordance with the invention, a folding machine for folding sheets of paper, board and the like. The folding machine comprises at least one knife-shaft unit for cutting and/or perforating and/or scoring and/or crimping and/or transporting the sheets. The at least one knife-shaft unit each has at least one pair of driven knife shafts and at least one respective processing unit mounted and rotationally fixed on each of the knife shafts. The at least one processing unit has a split construction with at least two ring-segment-shaped partial shells and connecting elements for interconnecting the partial shells.

The folding machine according to the invention for folding sheets of paper, board and the like therefore has at least one knife-shaft unit for cutting, perforating, scoring, crimping the sheets or subjecting the latter to similar operations. The folding machine is, in particular, a combination folding machine, which has both buckle-folding and knife-folding devices, or a buckle-folding machine. The knife-shaft unit has at least one pair of driven knife shafts, of which the axes are oriented parallel to one another and at right angles to the sheet-transporting direction. At least one processing unit is fitted in a respectively rotationally fixed manner on a respective knife shaft. The processing unit may have a knife holder for retaining knives or may have at least one transporting roller. The transporting roller in this case may have at least one surface against which is positioned a knife which is mounted on the other knife shaft. The knives are circular knives or blades which are constructed appropriately for cutting, perforating, scoring or crimping purposes. The knife holder serves for accommodating a knife so that the latter is fixed against rotation and displacement. The processing units are advantageously of split construction and are formed by a plurality of ring-segment-shaped partial shells. The partial shells of the processing units can be connected to one another by connecting elements.

This renders straightforward assembly and dismantling of the processing units possible without it being necessary to remove the knife shafts from the folding machine.

In accordance with another particularly advantageous feature of the folding machine of the invention, the knives are likewise of split construction and are formed in each case by a plurality of partial disks. This advantageously ensures that it is also possible for the knives to be fitted and removed straightforwardly and quickly. The split construction of the knife holders and of the knives advantageously reduces the set-up time period to a significant extent.

In accordance with a further particularly advantageous feature of the folding machine of the invention, a respective processing unit is formed from half-shells. The knives are advantageously formed in each case by two half-disks. Forming the respective elements in two parts has the advantage that they can be straightforwardly fitted and removed and, at the same time, the number of abutment locations between the partial shells and/or the partial disks remains limited to two in each case.

In accordance with an added particularly advantageous feature of the folding machine of the invention, the processing unit can be safeguarded against rotation and displacement relative to the knife shaft by a fixing element. The fixing element may, in particular, be a locking screw. A processing unit is clamped to the knife shaft through the use of the locking screw.

In accordance with a first advantageous embodiment of the folding machine of the invention, a respective processing unit is formed by two half-shells. The half-shells are connected to one another at a first abutment edge by at least one joint and at a second abutment edge by at least one connecting element. The connecting element is advantageously an easy-to-release connecting element, for example a screw or a clasp.

In accordance with a second advantageous embodiment of the folding machine of the invention, a respective processing unit is formed by two half-shells which are connected to one another at a first abutment edge by at least one connecting element and at a second abutment edge by at least one further connecting element. The connecting elements are advantageously easy-to-release connecting elements, for example screws or clasps.

In accordance with a third advantageous embodiment of the folding machine of the invention, a respective knife shaft has two recesses introduced in the longitudinal direction, for example dovetail-like grooves. A respective processing unit is formed by two half-shells and a respective half-shell is connected to the knife shaft by at least one connecting element, in particular a screw, with the respective connecting element engaging in one of the recesses.

In accordance with an alternative, particularly advantageous and therefore preferred embodiment of the folding machine of the invention, the processing unit is formed by two half-shells which are constructed to complement one another in step form in each case along their two abutment edges. The two half-shells rest with surface contact one upon the other along the two abutment edges. In the region of a respective step, in each case one bore is formed parallel to the axis of rotation of the processing unit. When the two half-shells rest one upon the other along their abutment edges, then the bores of the first half-shell are aligned with the bores of the second half-shell. The bores accommodate cylindrical connecting elements for connecting the two half-shells. These connecting elements advantageously each have an axial displacement-prevention device. The advantage of this variant is that the two half-shells can be connected to one another straightforwardly, and the use of the connecting elements avoids radial release of the half-shells during operation of the processing unit. The two half-shells are connected and separated by at least one of the two half-shells being displaced parallel to the axis of rotation of the processing unit.

In a development of this variant, an advantageous embodiment of a respective connecting element has a screw which has its head accommodated by the first half-shell and has its shank projecting into the bore of the second half-shell. The screws have a torque-proof threaded sleeve screwed onto them, in particular in the region of their foot. When the screw is rotated, the threaded sleeve acts on a ring or partial ring positioned around the screw and expands the same. The ring or partial ring thus acts as an axial displacement-prevention device.

In a development of the variant, a particularly advantageous embodiment of a respective connecting element has a pin which has its head accommodated by the second half-shell and has its shank projecting into the bore of the first half-shell. The shank in this case is enclosed, at least in part, by a spring, in particular a helical spring. Butting against the head of the pin is a ring or partial ring which is expanded by the force of the spring and thus acts as an axial displacement-prevention device.

With the objects of the invention in view, there is concomitantly provided a knife holder for a knife shaft of a folding machine. The knife holder includes two tubular elements forming the knife holder. The tubular elements are advantageously formed in each case by two half-shells which can be connected to one another and/or the knife shaft by connecting elements. A first tubular element has its inner lateral surface resting on the knife shaft. A knife can be introduced onto this tubular element and the second tubular element has an internal thread screwed onto an external thread of the first tubular element. Advantageous developments of the knife holder can be made in a manner analogous to the above-described developments of the folding machine.

Other features which are considered as characteristic for the invention are set forth in the appended claims.

Although the invention is illustrated and described herein as embodied in a folding machine and a knife holder for a knife shaft of a folding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
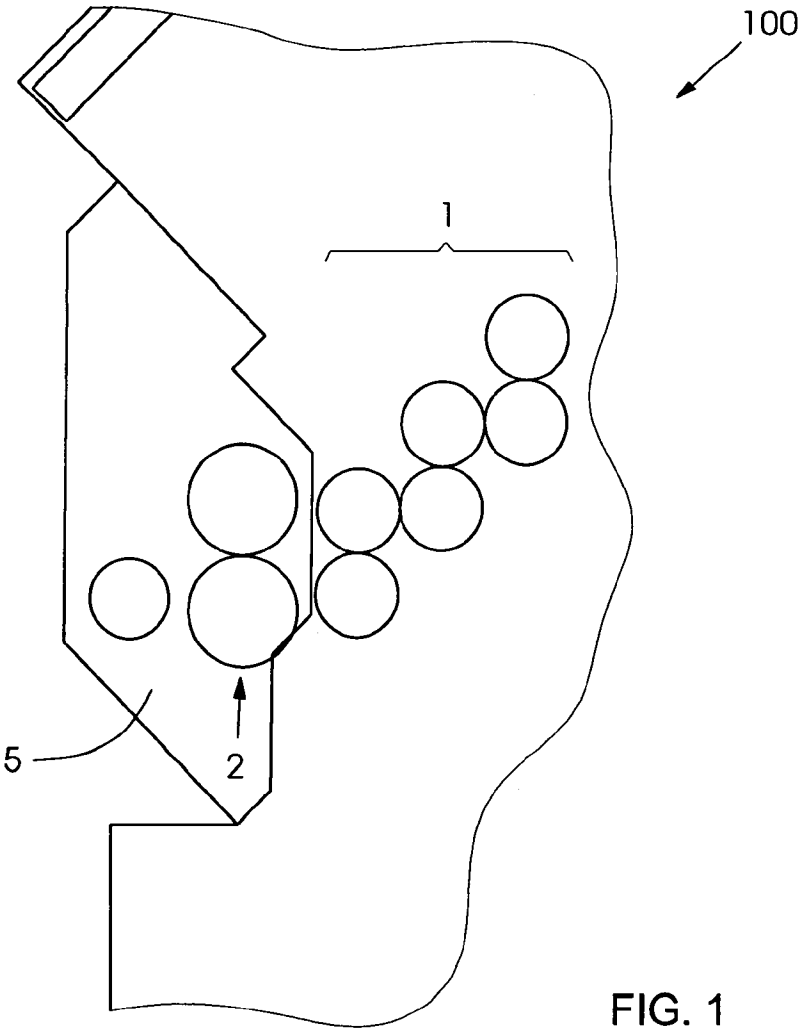
FIG. 1 is a fragmentary, diagrammatic, side-elevational view of a folding machine having a plurality of successive folding rollers for buckle-folding configurations (which are not illustrated specifically) and having a pair of knife shafts which follow on the left-hand side of the figure and are mounted in a separate roller frame which, for its part, can be displaced along a stationary guide.

Referring now to the figures of the drawings in detail and first, particularly, to FIG. 1 thereof, there is seen an exemplary embodiment of a folding machine 100 which is represented diagrammatically and is a buckle-folding machine for producing signatures with multiple folds using a folding-roller configuration 1 and non-illustrated associated buckle plates. To this extent, a plurality of folding devices are provided. The last of these folding devices is followed by a pair of knife shafts 2 mounted in a separate roller frame 5.

Figure 2:
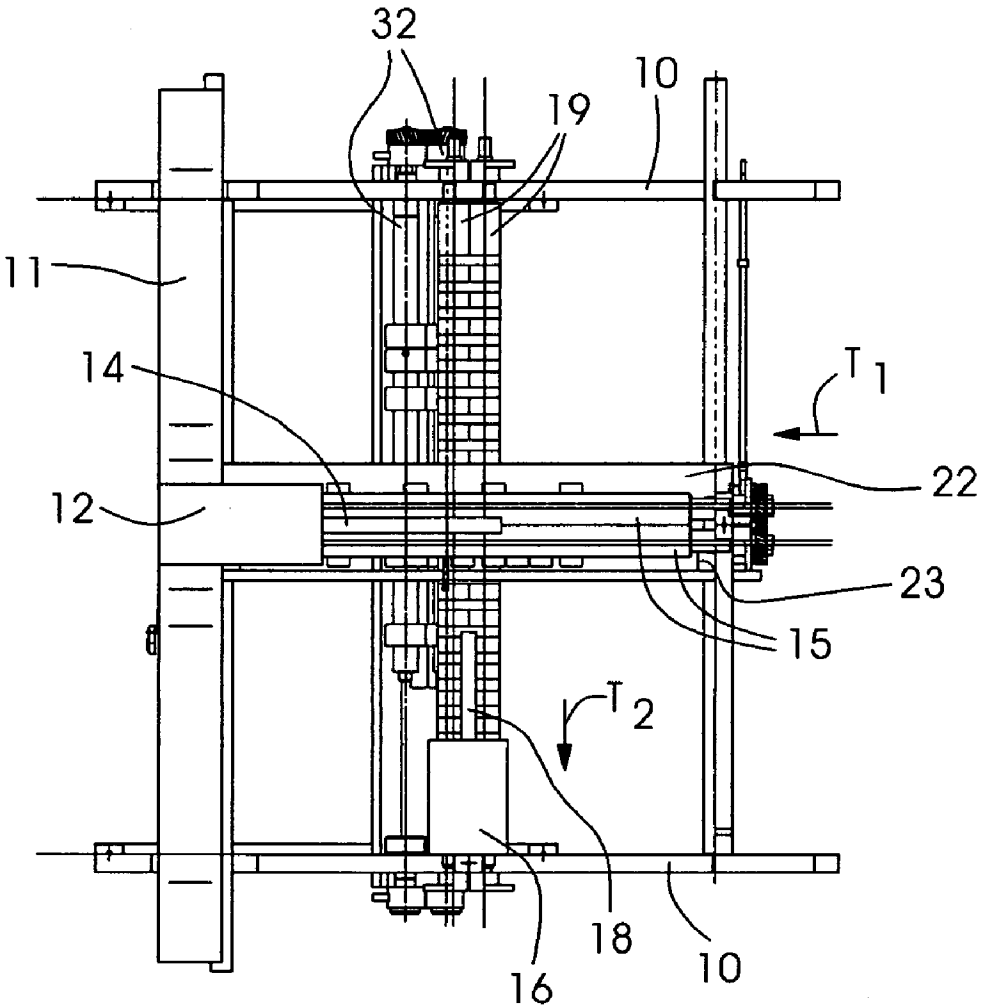
FIG. 2 is a plan view of part of an embodiment of the folding machine which includes two knife-folding device.

FIG. 2 shows a diagrammatic plan view of a region of the knife-folding devices of a preferred embodiment of the folding machine 100 according to the invention. The knife-folding devices 12, 14, 15, 16, 18, 19 themselves are only shown diagrammatically.

In FIG. 2, it is possible to see two side walls 10 of the folding machine 100 which are spaced apart parallel to one another and are connected to one another, inter alia, by a third side wall 11. This third side wall 11 is perpendicular to the other two side walls 10. The two parallel side walls 10 are typically oriented in accordance with a direction $T_1$ in which the sheets are transported through the buckle-folding device. This transporting direction $T_1$ of the sheets also corresponds to the direction $T_1$ in which the sheets are transported as they enter into the first knife-folding device 12, 14, 15. There, the sheet strikes against non-illustrated stops and comes to rest. A first knife drive 12 uses a first folding knife 14 to force the sheet between first folding rollers 15 in order to produce a first cross fold. The sheet then passes through a knife-shaft unit 22, 23 where it is, for example, cut, perforated or scored in accordance with the configuration of the knife shafts 22, 23, in order to then pass to a second knife-folding device 16, 18, 19 in a second transporting direction $T_2$. At this second knife-folding device, the sheet once again strikes against non-illustrated stops and comes to rest again. The sheet has thus been deflected through 90° from the first transporting direction $T_1$ to the second transporting direction $T_2$.

A second knife drive 16 then uses a second folding knife 18 to force the sheet between second folding rollers 19 in order to produce a second cross fold. The sheet then passes through a knife-shaft unit 32 where it is, for example, further cut, perforated or scored in accordance with a configuration of knife shafts of the knife-shaft unit 32. The latter could be followed by a non-illustrated delivery known to a person skilled in the art or by a further, third non-illustrated knife-folding device which would be equipped correspondingly. The sheet would thus be deflected through a further 90° from the second transporting direction $T_2$ to the next transporting direction. This transporting direction corresponds, once again, to the first transporting direction $T_1$, although the sheet is located on a lower level than the first transporting plane.

The folding machines 100 which are illustrated in FIGS. 1 and 2 may each have processing units which are illustrated and described in the following FIGS. 3 to 8.

FIGS. 3 to 5 each show a processing unit which has a transporting roller 40.1.

Figure 3B:
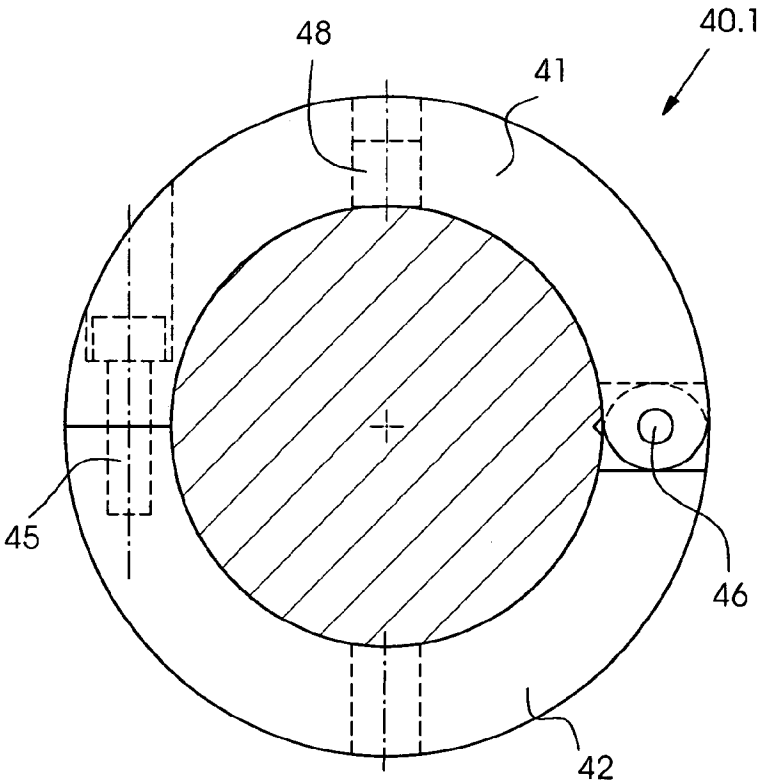
FIGS. 3A and 3B are respective side-elevational and end-elevational views of a first embodiment of a transporting roller.
Figure 3A:
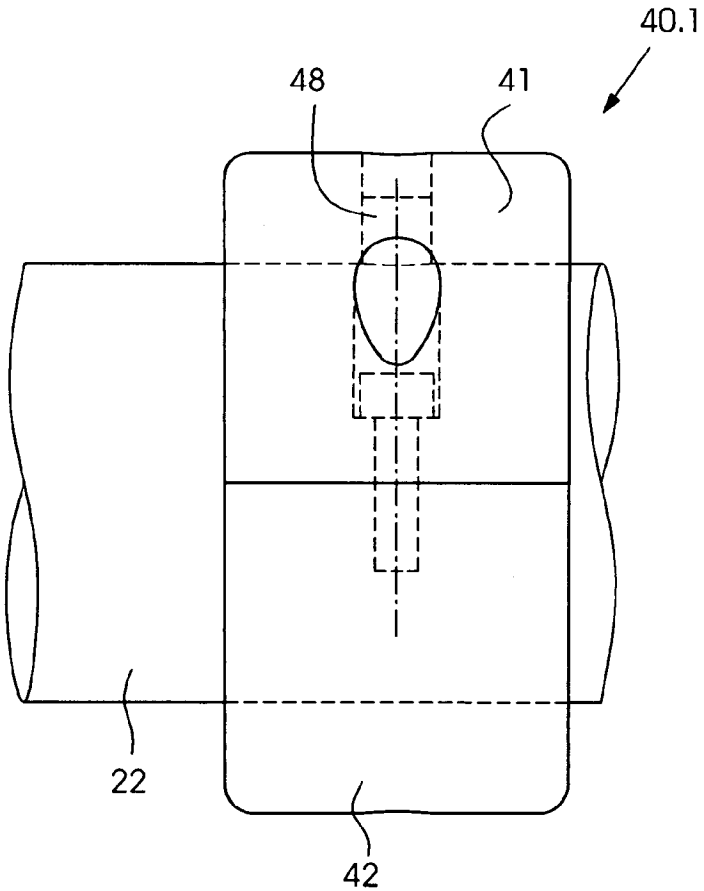

FIGS. 3A and 3B show part of a first embodiment of the transporting roller 40.1, namely a first ring-segment-shaped half-shell 41 and a second ring-segment-shaped half-shell 42, which together form a transporting roller and are fitted on the knife shaft 22. These half-shells are connected permanently to one another by a joint 46 at a first abutment location between the first half-shell 41 of the transporting roller and the second half-shell 42 of the transporting roller. In order to fit the transporting roller 40.1, the first half-shell 41 and second half-shell 42 are swung open, suspended in the knife shaft 22 and connected to one another by a screw-connection 45 at a second joint location of the first half-shell 41 and the second half-shell 42. It can be seen from FIG. 3B that the internal diameter of the transporting roller 40.1 corresponds approximately to the external diameter of the knife shaft 22. The tolerances of the two diameters in this case are such that the transporting roller 40.1 can still be displaced relative to the knife shaft 22 even when the two half-shells 41 and 42 are connected to one another by the screw-connection 45. Fixing of the transporting roller 40.1 relative to the knife shaft 22, in order to prevent rotation and displacement of the transporting roller 40.1, takes place by a fixing element, for example a locking screw 48, which may be located as shown.

Figure 4B:
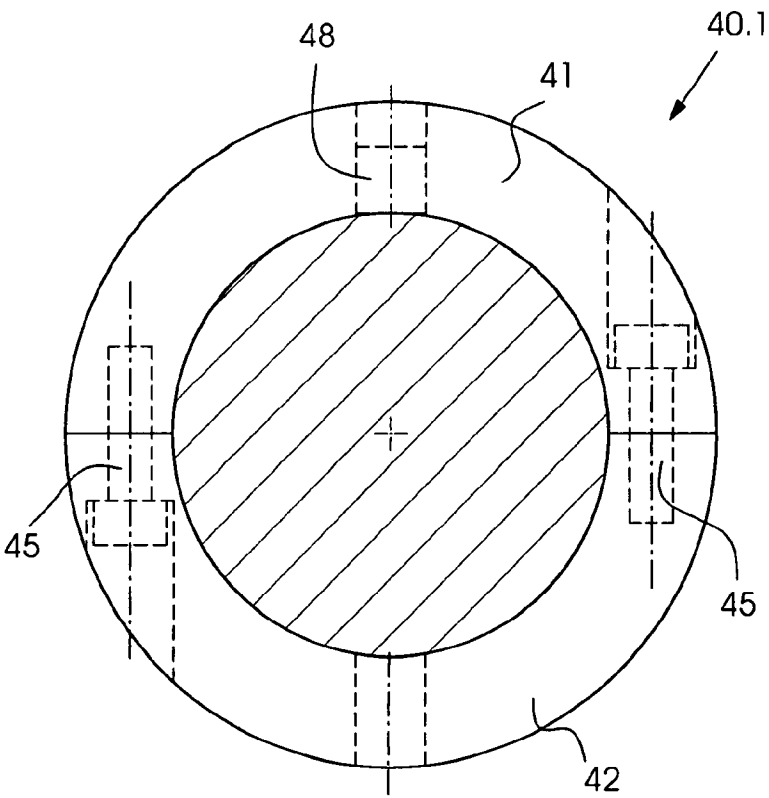
FIGS. 4A and 4B are respective side-elevational and end-elevational views of a second embodiment of a transporting roller.
Figure 4A:
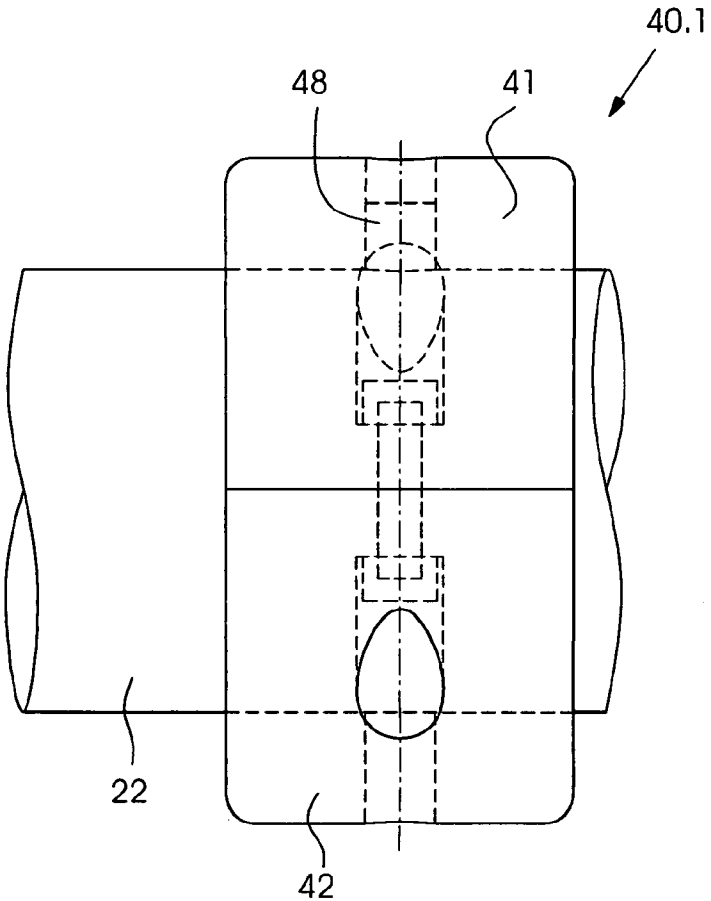

FIGS. 4A and 4B illustrate a second embodiment of a transporting roller 40.1. The latter is constructed, in a manner analogous to the first embodiment described above, from a first half-shell 41 and a second half-shell 42. The latter are connected to one another by a first screw-connection 45 at a first abutment location of the two half-shells 41 and 42. The half-shells 41 and 42 are connected to one another by a second screw-connection 45 at a second abutment location of the first half-shell 41 and the second half-shell 42.

Figure 5B:
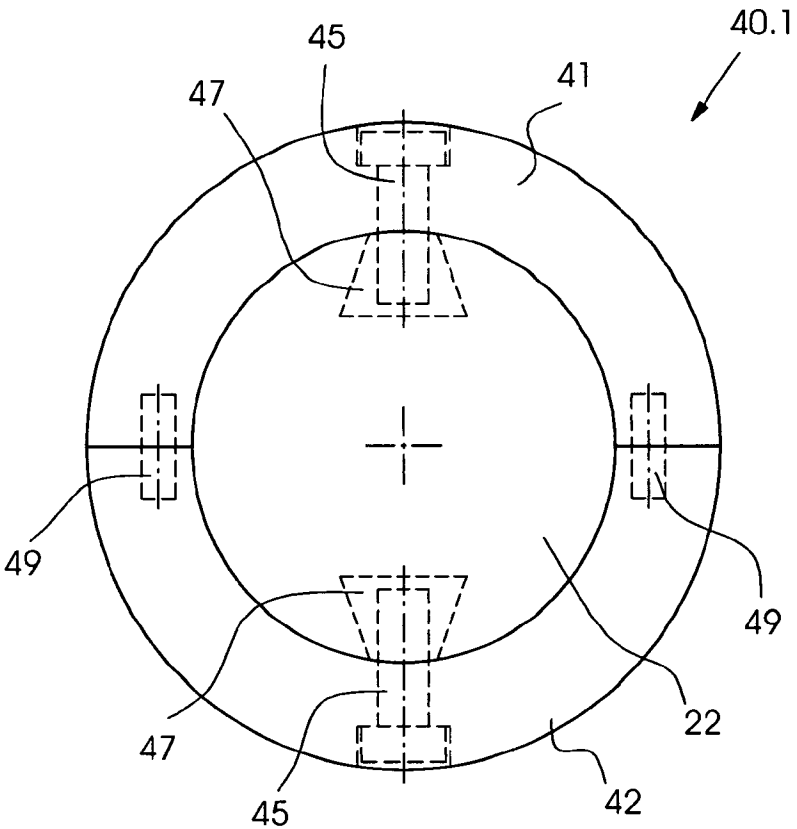
FIGS. 5A and 5B are respective side-elevational and end-elevational views of a third embodiment of a transporting roller.
Figure 5A:
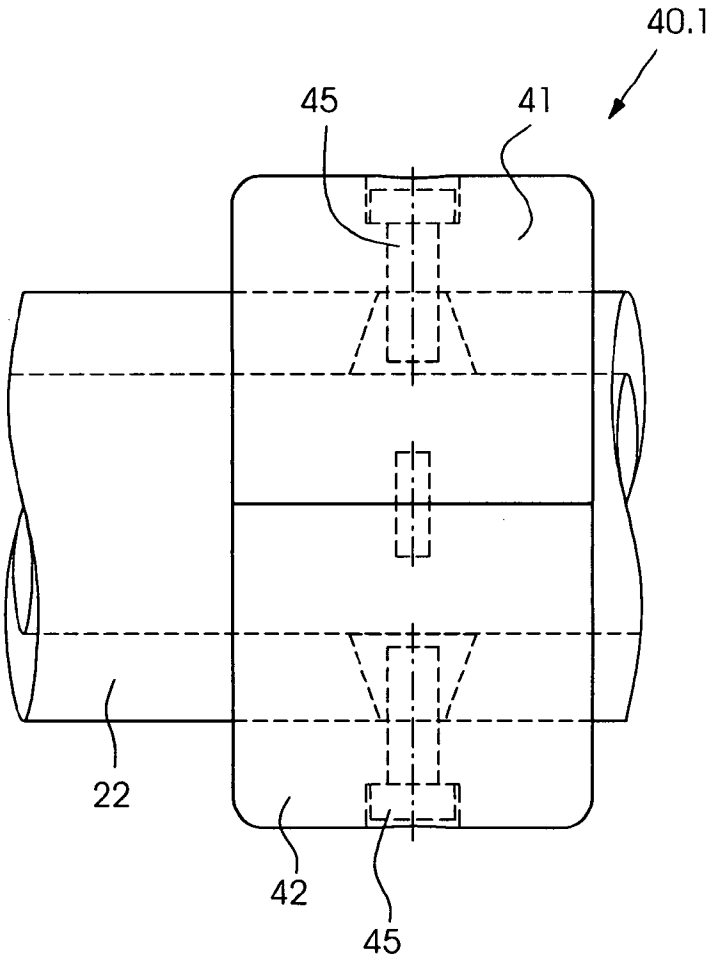

FIGS. 5A and 5B show a third embodiment of a transporting roller 40.1, which is constructed, in a manner analogous to the embodiments of the transporting roller described above, from a first half-shell 41 and a second half-shell 42. As can be gathered from FIG. 5B, the knife shaft 22 has two dovetail-like grooves 47. The center lines of the two longitudinal grooves 47 in this case are located in a single plane. The first half-shell 41 and the second half-shell 42 each have a bore which accommodates a screw 45. The half-shells 41 and 42, which are positioned radially on the knife shaft 22, are respectively clamped by the screw 45, with a nut in the form of a cone which engages in the dovetail-like groove 47 of the knife shaft 22, by virtue of the screw 45 being tightened. In addition, the half-shells 41 and 42 may also be connected to one another by connecting pins 49.

Figure 6B:
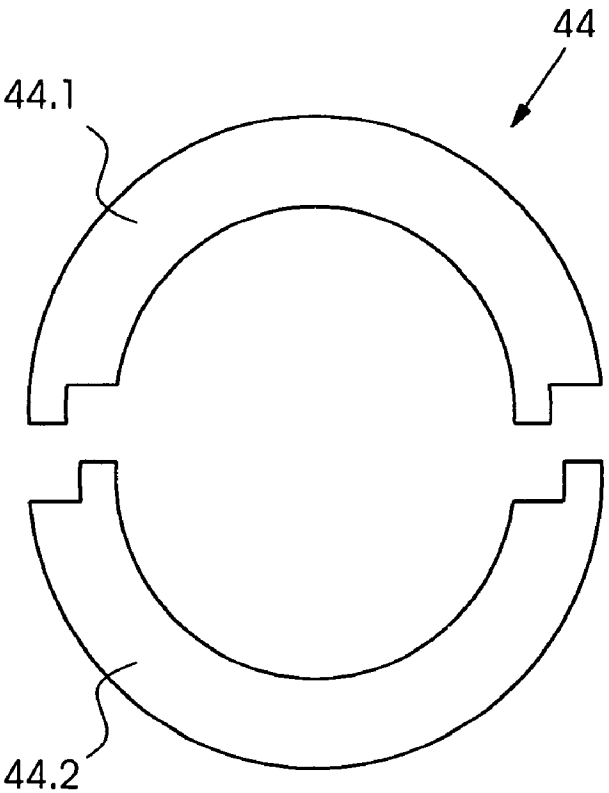
FIG. 6B is an end-elevational view of a two-part knife.
Figure 6A:
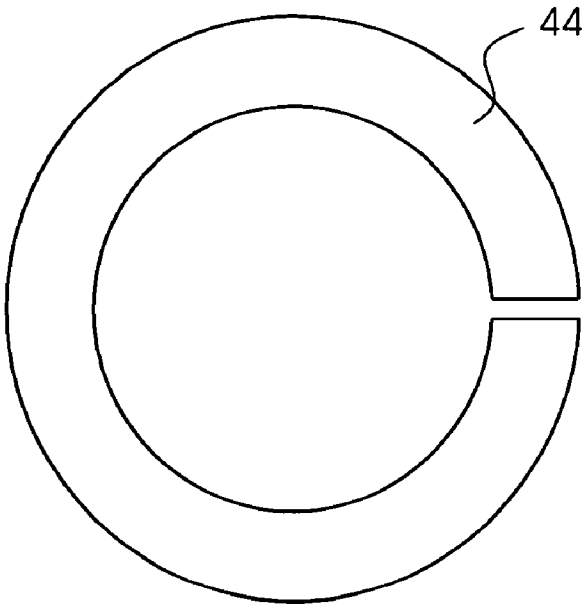
FIG. 6A is an end-elevational view of a slit knife.

FIG. 6A shows a single-piece knife 44 which is slit and can easily be fitted on a knife holder 40.3 (see FIGS. 7A-7D), without any need for the knife holder 40.3 to be dismantled, by bending two legs of the knife 44. Such slit knives 44 may have only a small material thickness in order for it to still remain possible to bend the two legs. Slit knives 44 are therefore suitable, in particular, for cutting and perforating sheets of paper.

FIG. 6B shows a knife 44 which is constructed from a first partial disk 44.1 and a second partial disk 44.2. The partial disks 44.1 and 44.2 may be connected to one another at two abutment locations of the partial disks 44.1 and 44.2. A connecting mechanism is not illustrated in detail and may be constituted, for example, by latch-in elements, in which case the two partial disks 44.1 and 44.2 can be clipped into one another. Such multi-part knives 44 are used particularly when the function of the knife requires it to have a certain material thickness, for example a knife for crimping or scoring purposes. Split knives 44 may likewise be used when the material which is to be processed, for example a sheet of cardboard, requires knives 44 of relatively large material thickness and thus of relatively high stability.

FIGS. 7A to 7D each show a processing unit (40) which has a knife holder 40.3.

The knife holders 40.3 may be constructed, in a manner analogous to the transporting rollers 40.1, from two half-shells 41, 42 which are connected to one another at their abutment locations.

Figure 7B:
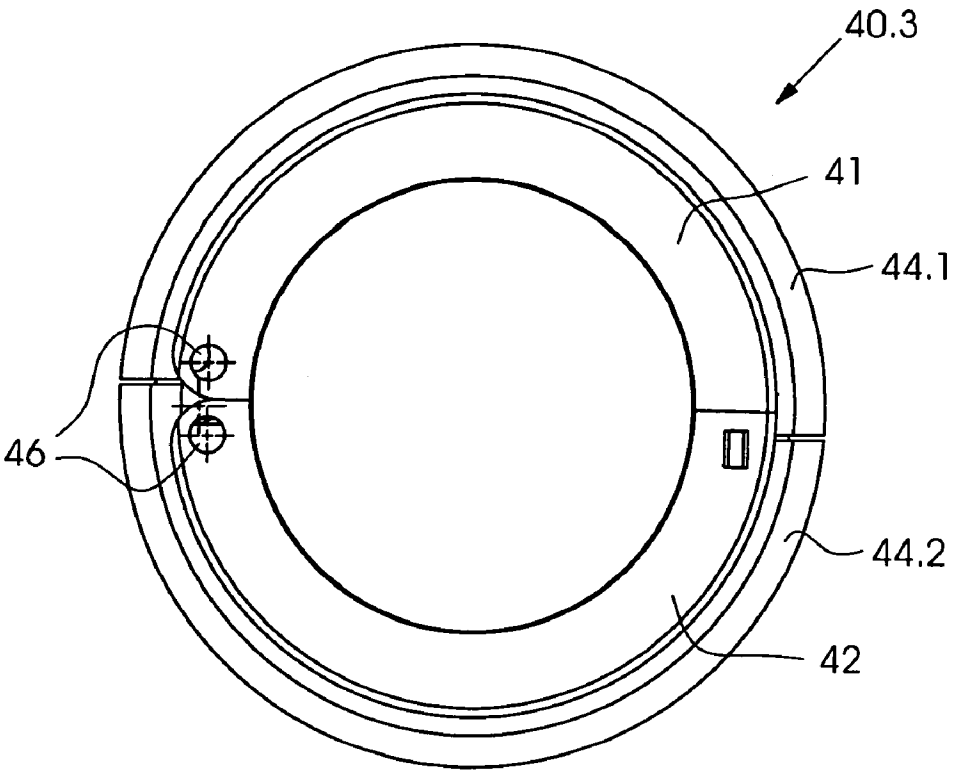
FIG. 7B is an end-elevational view of a knife holder.
Figure 7A:
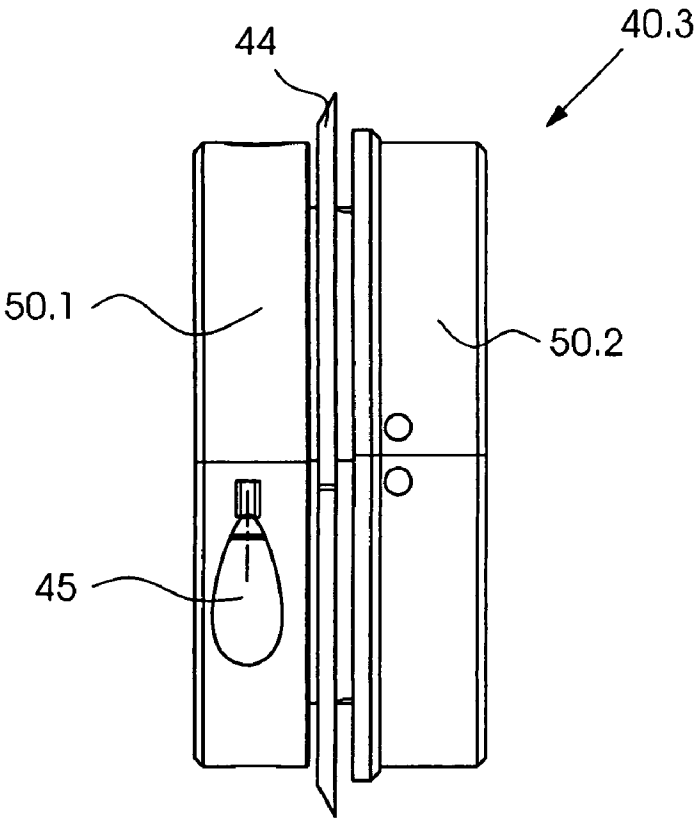
FIG. 7A is a side-elevational view of a knife holder.

FIG. 7A shows a side view of a knife holder 40.3 for accommodating a knife 44. The knife holder 40.3 in this case is formed by a first tubular element 50.1 and a second tubular element 50.2. As can be gathered from FIG. 7B, the knife 44 includes a first partial disk 44.1 and a second partial disk 44.2. The tubular elements 50.1 and 50.2 are likewise constructed in two parts and each include a first half-shell 41 and a second half-shell 42. The two half-shells 41 and 42 are connected to one another at the left-hand abutment location thereof by a double joint 46, 46. As can be gathered from FIG. 7A, the first and second half-shells 41, 42 are connected to one another at the right-hand abutment location thereof by a screw-connection 45. The formation of the tubular elements 50.1 and 50.2 in two parts means that the latter can be straightforwardly fitted on a knife shaft and removed therefrom.

Figure 7D:
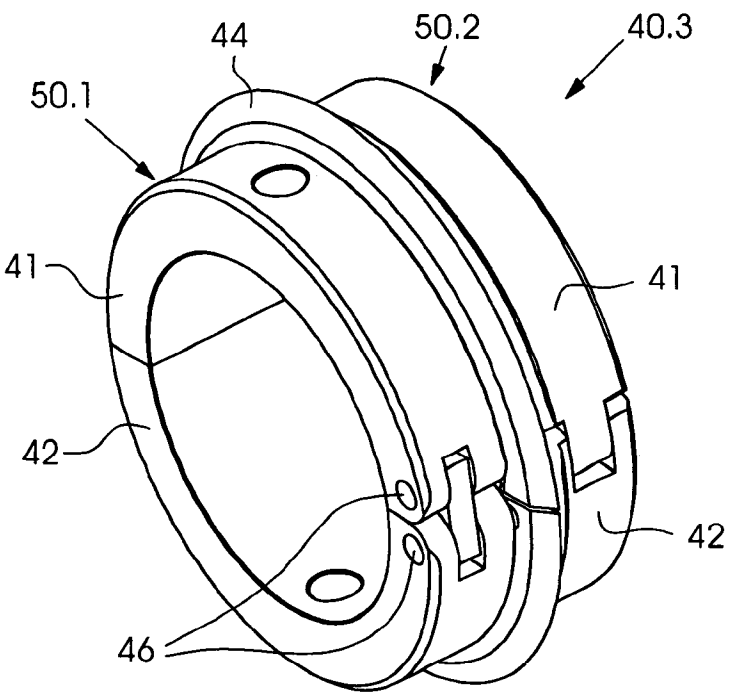
FIG. 7D is a perspective view of an assembled knife holder.
Figure 7C:
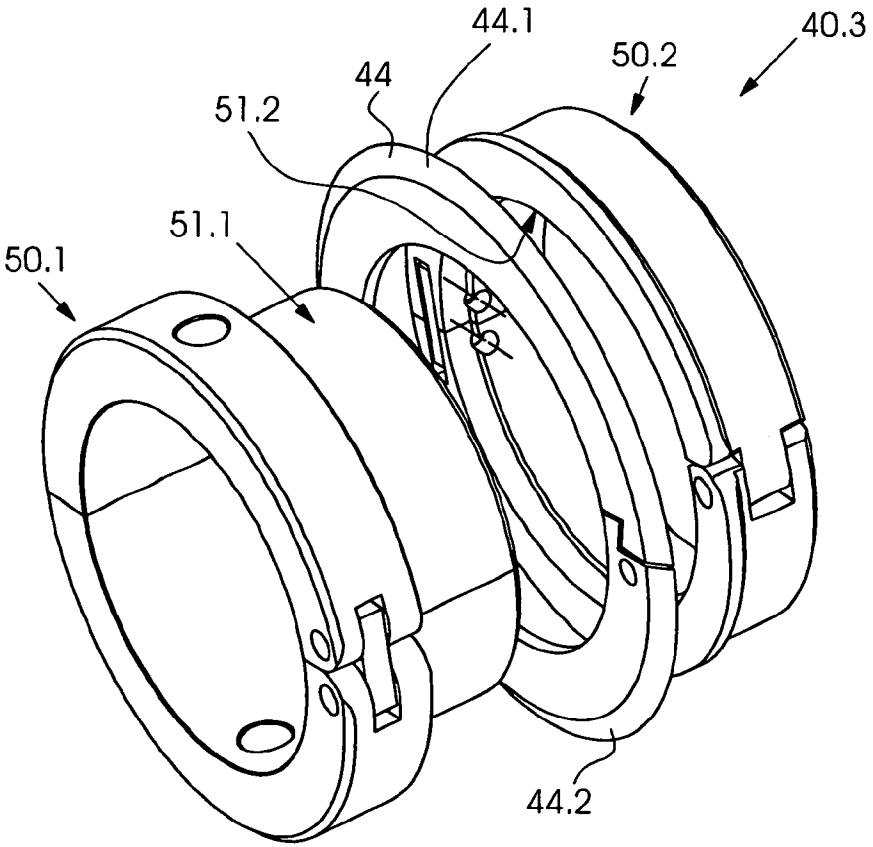
FIG. 7C is an exploded, perspective view of a knife holder.

FIG. 7C shows how to assemble a knife holder 40.3. A first tubular element 50.1 is swung open and has its inner lateral, jacket or casing surface positioned on a knife shaft. A screw-connection 45 screw-connects the first and second half-shells 41 and 42 of the first tubular element 50.1 to one another. The first tubular element 50.1 has a portion of reduced external diameter with a lateral surface of this portion being provided with an external thread 51.1. The split knife 44 is positioned thereon and the two partial disks 44.1 and 44.2 are connected to one another. In order to fix the knife 44, the second tubular element 50.2 is positioned on the knife shaft in the swung-open state and the two half-shells 41 and 42 of the second tubular element 50.2 are connected to one another by a screw-connection 45. The second tubular element 50.2, which is provided with an internal thread 51.2, is screwed onto the external thread 51.1 of the first tubular element 50.1. The knife 44 is clamped by the two tubular elements 50.1 and 50.2 being screw-connected. An assembled knife mount 40.3 with a knife 44 is illustrated in FIG. 7D.

FIG. 8 show a processing unit 40 which has two transporting rollers 40.1.

Figure 8A:
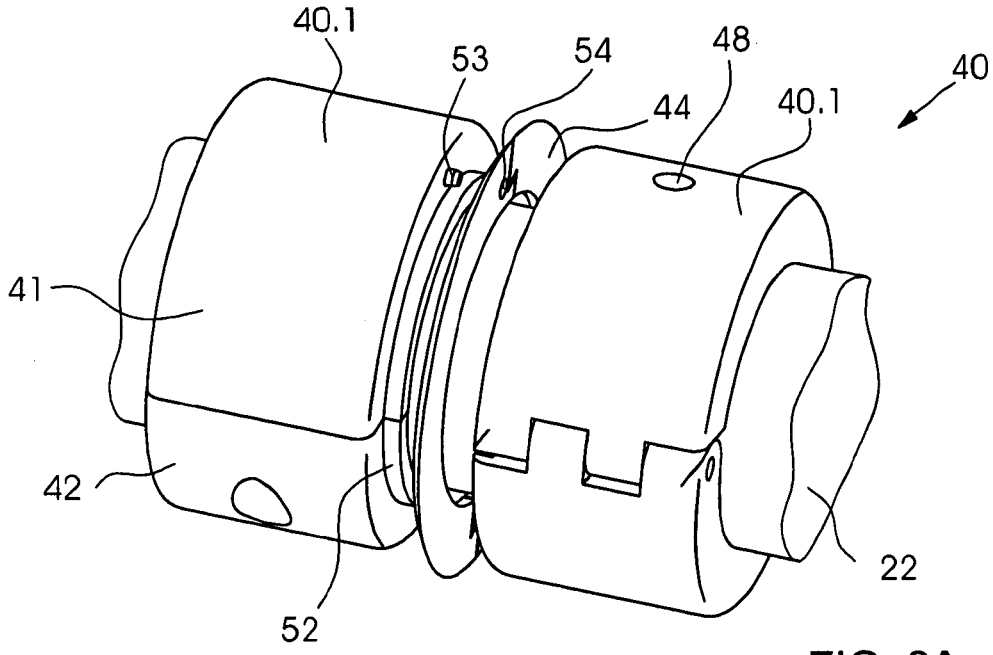
FIG. 8A is a perspective view of a knife holder including two transporting rollers.
Figure 8B:
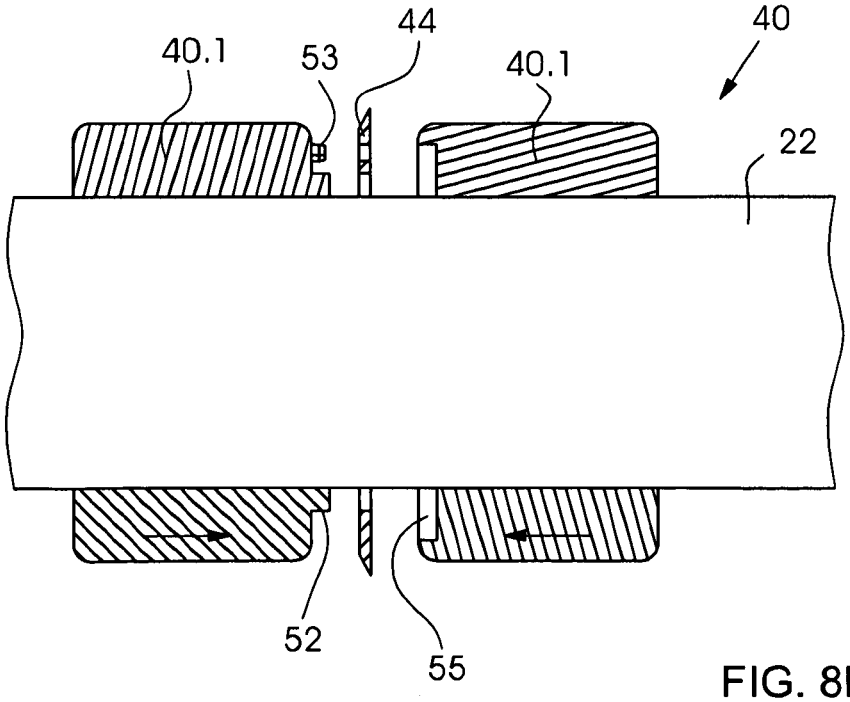
FIG. 8B is a fragmentary, partly-sectional view of the knife holder of FIG. 8A.

As is illustrated in FIG. 8, a knife 44 can also be clamped by two transporting rollers 40.1. The transporting rollers 40.1 in this case also assist the transportation of sheets. As is illustrated in FIG. 8A, the transporting rollers 40.1 are of split construction and each includes two half-shells 41 and 42. The half-shells 41 and 42 may be connected to one another in a manner corresponding to one of the variants described above. The left-hand transporting roller 40.1 has a stepped formation 52 on its right-hand end surface. The external diameter of the stepped formation 52 corresponds approximately to the internal diameter of the knife 44, and the latter therefore butts against the stepped formation 52 in the fitted state. In order to prevent the knife 44 from rotating, the left-hand transporting roller 40.1 has a pin 53 which engages in a hole 54 of the knife 44. The knife 44 is safeguarded against displacement by a second transporting roller 40.1. The second transporting roller 40.1, located on the right-hand side, has, on its left-hand end surface, a groove 55 which accommodates the stepped formation 52 of the left-hand transporting roller 40.1. The knife 44 is clamped between the two transporting rollers 40.1 by virtue of the two transporting rollers 40.1 being pushed toward one another, as is illustrated in FIG. 8B. The transporting rollers 40.1 are then safeguarded, as has already been described above, against rotation and displacement on the knife shaft 22 by fixing elements 48.

Figure 9A:
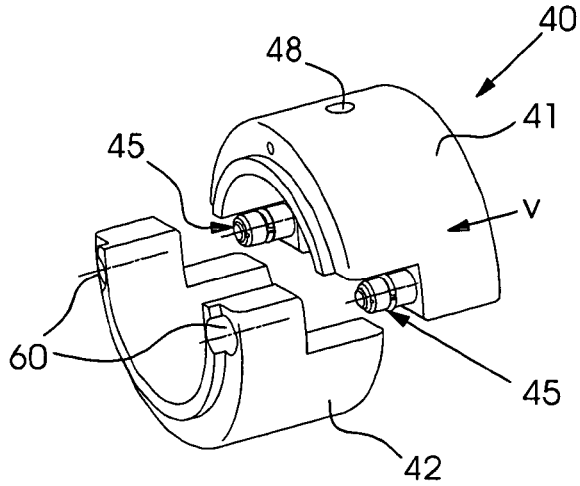
FIGS. 9A, 10A and 11A are perspective views of various embodiments of a processing unit prior to assembly.
Figure 9B:
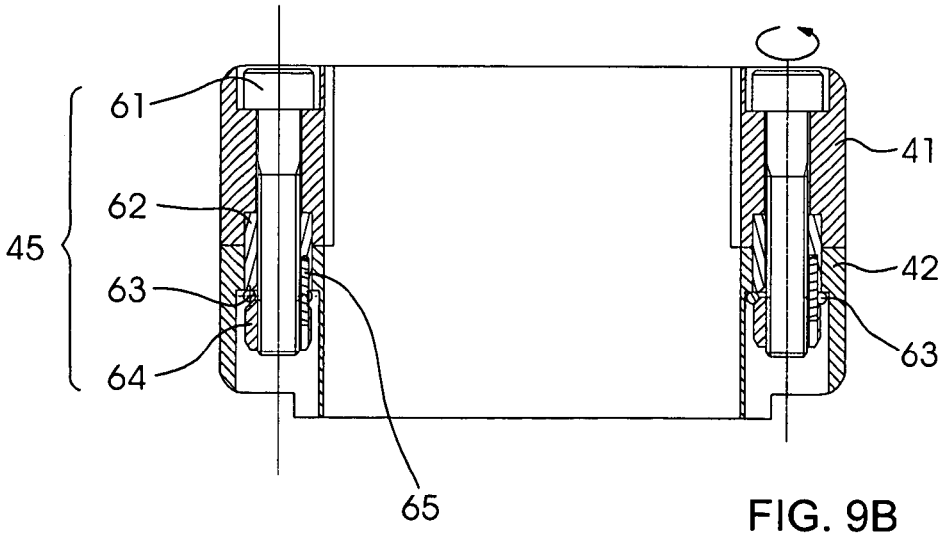
FIGS. 9B, 10B and 11B are sectional views of the embodiments of FIGS. 9A, 10A and 11A for the purpose of describing assembly.
Figure 10A:
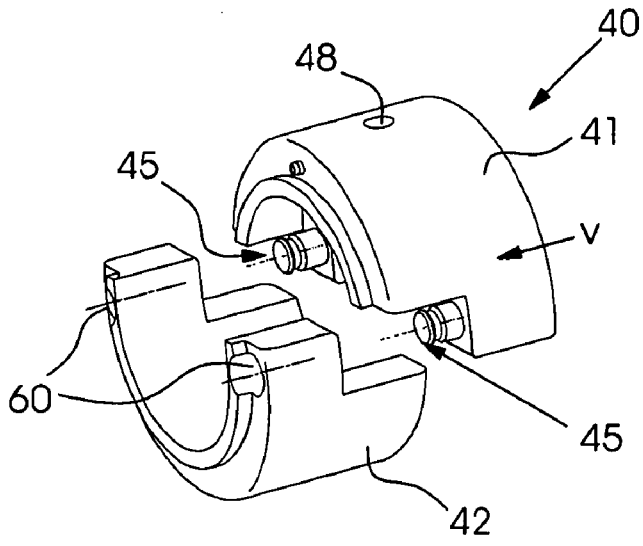
Figure 10B:
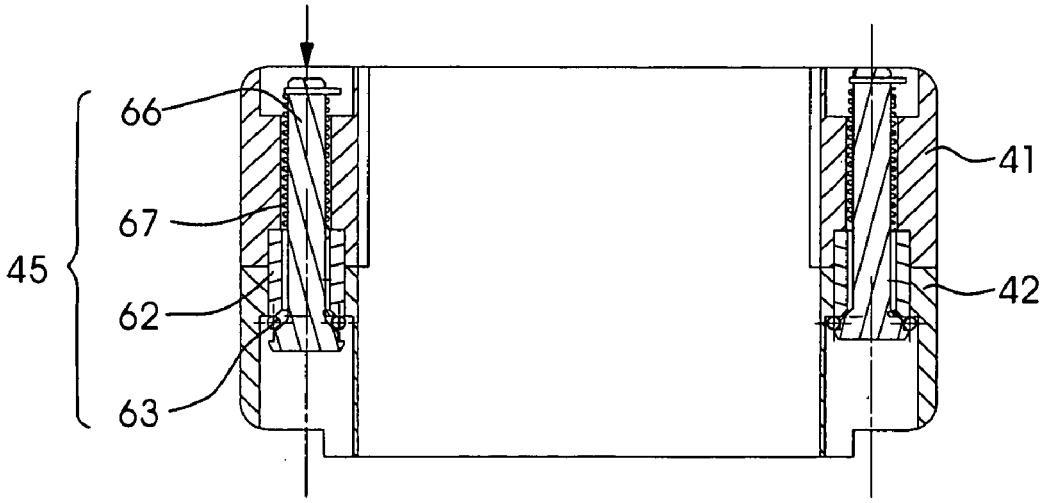
Figure 11A:
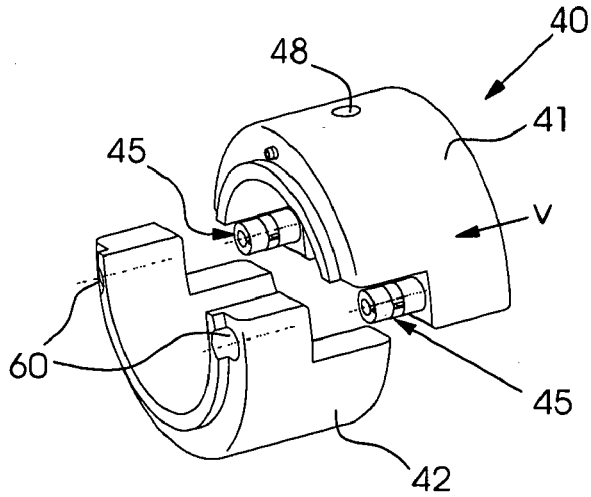
Figure 11B:
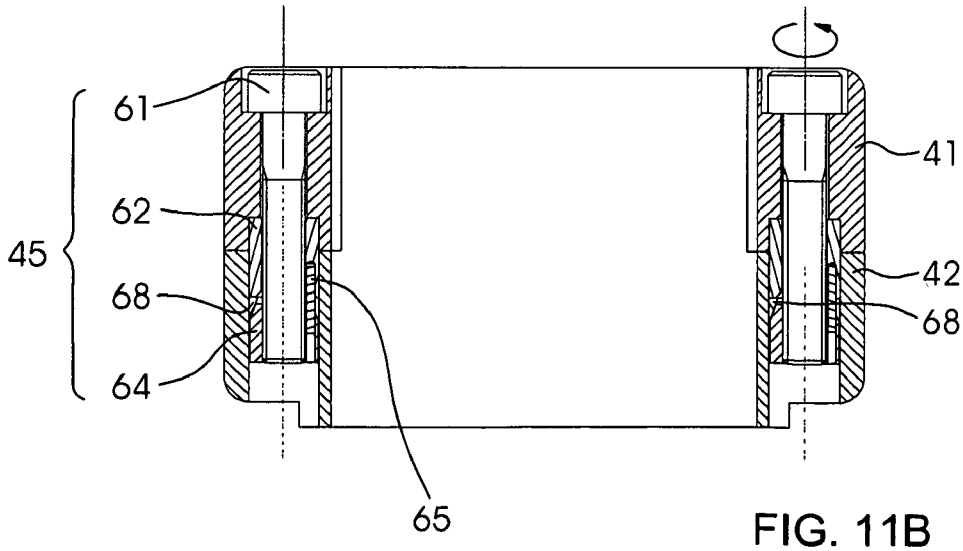
Figure 12:
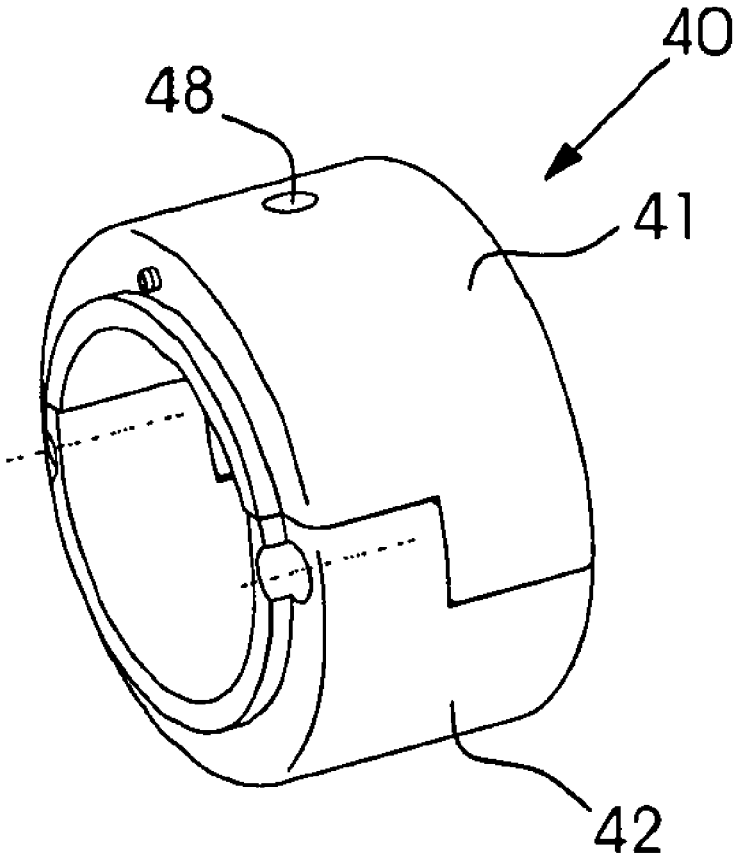
FIG. 12 is a perspective view of processing units according to FIGS. 9, 10 and 11 in an assembled state.

FIGS. 9A and 9B, FIGS. 10A and 10B, FIGS. 11A and 11B and FIG. 12 show alternative embodiments of the processing unit 40. The latter includes, as is illustrated in FIGS. 9A, 10A and 11A, a first half-shell 41 and a second half-shell 42. The abutment edges of the half-shells 41, 42 are constructed in step form. A bore 60 in this case is introduced into a respective step of a respective half-shell 41, 42. A respective connecting element 45 is located in the non-illustrated bores 60 of the first half-shell 41. The two half-shells 41, 42 are connected to one another by virtue of a displacement movement v of the first half-shell 41 parallel to the axis of rotation of the processing unit 40. The connecting elements 45 in this case are accommodated by the bores 60 in the steps of the second half-shell 42. The state in which the half-shells 41, 42 are connected to one another through the use of the connecting elements 45 is illustrated in FIG. 12. A fixing element, which safeguards the processing unit 40 against rotation and displacement on a non-illustrated knife shaft 22, 23, is denoted in this case by reference numeral 48.

FIGS. 9B, 10B and 11B will be used hereinbelow to describe various embodiments of the processing unit 40 which differ specifically by way of the configuration of the connecting element 45.

The left-hand half of FIG. 9B shows the connecting element 45 in the assembled state of the processing unit. The right-hand half of FIG. 9B shows the connecting element 45 following assembly of the processing unit, with the processing unit 40 thus being in its operating state. According to the illustration of the assembled state, the two half-shells 41 and 42 have already been displaced in relation to one another such that they rest with surface contact one upon the other along their step-form abutment edges. A screw 61 is accommodated by the first half-shell 41 and retained by the same. The shank of the screw 61 projects into the second half-shell 42. In the region of the shank, the screw 61 has a sleeve 62, a ring 63 and a threaded sleeve 64 located thereon. The threaded sleeve 64 is screwed onto the screw 61 in the region of the foot of the latter and has, at its top end, a cone on which the ring 63 rests. The threaded sleeve 64 is connected to the sleeve 62 through the use of a pin 65 and is thus safeguarded against rotation. Rotation of the screw 61 moves the threaded sleeve 64 with the cone in the direction of the ring 63, as a result of which the ring 63 is expanded. As is illustrated in the right-hand half of FIG. 9B, the diameter of the ring 63 thus becomes greater than the diameter of the bore of the second half-shell 42. An axial displacement-prevention device is realized as a result, and the two half-shells 41 and 42 are fixed to one another. In order for it to be possible for the half-shells 41 and 42 to be separated from one another again, the screw 61 is rotated in the opposite direction, as a result of which the pressing of the threaded sleeve 64 on the ring 63 is lessened and the ring 63 resumes its original diameter. With its original diameter, the ring 63 can then be guided through the bore of the second half-shell 42.

In that variant of the processing unit 40 which is illustrated in FIG. 10B, the connecting element 45 is formed by a pin 66 with an axial displacement-prevention device. Wound around the pin 66 is a helical spring 67 which, according to the illustration in the left-hand half of FIG. 10B, is subjected to an external force and thus compressed. Resting on the conical head of the pin 66 is a ring 63, which is supported against a sleeve 62. By virtue of the force acting on the foot of the pin 66, the ring 63 is relieved of loading and can resume its original shape, with a diameter which is smaller than the diameter of the bore in the second half-shell 42. This makes it possible to introduce the head of the pin 66 into the bore of the second half-shell 42. If the force to which the foot of the pin 66 is subjected is then dissipated, then the spring 67 pulls the head of the pin 66 in the direction of the first half-shell 41 and moves the cone of the head in the direction of the ring 63 and expands the latter. As is illustrated in the right-hand half of FIG. 10B, the ring 63 in this case assumes a shape with a diameter which is larger than the diameter of the bore in the second half-shell 42 and thus acts as an axial displacement-prevention device. The two half-shells 41 and 42 are thus fixed to one another. In order for it to be possible for the half-shells 41, 42 to be separated from one another again, a force has to be applied to the feet of the pins 66 again.

According to that embodiment of the processing unit 40 which is illustrated in FIG. 11B, a respective connecting element 45 has a screw 61 with an axial displacement-prevention device. The left-hand half of FIG. 11B illustrates the assembled state, while in the right-hand half of FIG. 11B, the processing unit 40 is in its operating state. In a manner similar to the embodiment which is illustrated in FIG. 9B, a sleeve 62 has been plugged onto the screw 61 and a threaded sleeve 64 has been screwed onto the same. The threaded sleeve 64 is likewise prevented from rotating by a pin 65. Instead of the ring 63, however, this embodiment makes use of a wedge-shaped ring 68 which has its sloping surface resting on a cone of the threaded sleeve 64. By virtue of the screw 61 being rotated, the threaded sleeve 64 is pressed against the wedge-shaped ring 68 and expands the same. The ring 68 in the expanded state is illustrated in the right-hand half of FIG. 11B. The wedge-shaped ring 68 in this case acts as a bracing element and is clamped in a force-locking manner into the bore of the second half-shell 42. A force-locking connection is one which connects two elements together by force external to the elements, as opposed to a form-locking connection which is provided by the shapes of the elements themselves. The wedge-shaped ring 68 thus provides an axial displacement-prevention device, and the two half-shells 41, 42 are fixed to one another. In order for it to be possible for the half-shells 41, 42 to be released from one another again, the screw 61 is rotated in the opposite direction, as a result of which the pressing of the threaded sleeve 64 on the wedge-shaped ring 68 is reduced and a friction-lock between the wedge-shaped ring 68 and second half-shell 42 is eliminated.

The invention claimed is:

1. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

said at least one processing unit having a split construction and being formed by two ring-segment-shaped half-shells interconnected at a first abutment edge by at least one swinging joint and at a second abutment edge by at least one connecting element; and said at least one processing unit having two transporting rollers for transporting the sheets and for clamping a knife.

2. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

said at least one processing unit having a split construction and being formed by two ring-segment-shaped half-shells interconnected at a first abutment edge by at least one swinging joint and at a second abutment edge by at least one connecting element;

a circular knife having a split construction and at least two partial disks together forming a circle; and said at least one processing unit having a transporting roller for transporting the sheets or a knife holder for retaining said knife.

3. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

said at least one processing unit having a split construction and being formed by two ring-segment-shaped half-shells interconnected at a first abutment edge by at least one swinging joint and at a second abutment edge by at least one connecting element;

a circular knife having a split construction and at least two partial disks together forming a circle; and said at least one processing unit having two transporting rollers for transporting the sheets and for clamping said knife.

4. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

said at least one processing unit having a split construction and being formed by two ring-segment-shaped half-shells interconnected at a first abutment edge by at least one swinging joint and at a second abutment edge by at least one connecting element;

a circular knife formed of two partial disks together forming a circle; and said at least one processing unit having a transporting roller formed by two half-shells for transporting the sheets or a knife holder for retaining said knife.

5. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

each respective one of said knife shafts having two recesses formed in longitudinal direction; and said at least one processing unit having a split construction formed of two ring-segment-shaped half-shells, and at least one respective screw engaging each respective one of said recesses and connecting a respective one of said half-shells to a respective one of said knife shafts.

6. A folding machine for folding at least sheets of paper and board, the folding machine comprising:

at least one knife-shaft unit for at least one of cutting, perforating, scoring, crimping or transporting the sheets;

said at least one knife-shaft unit each having at least one pair of driven knife shafts and at least one respective processing unit mounted and rotationally fixed on each of said knife shafts;

said at least one processing unit having a split construction and being formed of two ring-segment-shaped half-shells constructed to complement one another with a step shape along two abutment edges;

said at least one processing unit having cylindrical connecting elements for interconnecting said half-shells; and said two half-shells each having a respective bore formed therein parallel to an axis of rotation of said at least one processing unit, in vicinity of a respective step, for accommodating said cylindrical connecting elements for connecting said two half-shells.

7. The folding machine according to claim 6, wherein said cylindrical connecting elements each have an axial displacement-prevention device.

8. The folding machine according to claim 7, wherein each of said respective connecting elements has a screw with a head accommodated by a first one of said two half-shells and a shank projecting into said bore of a second one of said two half-shells, a torque-proof threaded sleeve screwed onto said screw, and a ring or partial ring positioned around said screw, said torque-proof threaded sleeve, upon rotation of said screw, acting on, expanding and causing said ring or partial ring to act as said axial displacement-prevention device.

9. The folding machine according to claim 8, wherein said torque-proof threaded sleeve is screwed in vicinity of a foot of said screw.

10. The folding machine according to claim 7, wherein each of said respective connecting elements has a pin with a head accommodated by a second one of said two half-shells and a shank projecting into said bore of a first one of said two half-shells, a ring or partial ring butting against said head of said pin, and a spring at least partly enclosing said shank and causing said ring or partial ring to expand and act as said axial displacement-prevention device.

* * * * *